US007138894B2

(12) United States Patent
Lo

(10) Patent No.: US 7,138,894 B2
(45) Date of Patent: Nov. 21, 2006

(54) ELECTROMAGNETIC BREAKER

(76) Inventor: Mei-Ling Lo, 235 Chung - Ho Box 8-24, Taipei (TW)

( * ) Notice: Subject to any disclaimer, the term of this patent is extended or adjusted under 35 U.S.C. 154(b) by 0 days.

(21) Appl. No.: 11/042,845

(22) Filed: Jan. 25, 2005

(65) Prior Publication Data

US 2006/0164191 A1 Jul. 27, 2006

(51) Int. Cl.
*H01H 67/02* (2006.01)
*H01H 67/00* (2006.01)

(52) U.S. Cl. ..... 335/132; 335/106; 335/131; 335/179

(58) Field of Classification Search ..... 335/177–179, 335/6, 106, 127, 131, 132, 180
See application file for complete search history.

(56) References Cited

U.S. PATENT DOCUMENTS 803,486 A * 10/1905 Hill ..... 335/126
2,278,971 A * 4/1942 Boehne ..... 335/157
3,040,146 A * 6/1962 Immel et al. ..... 335/136
3,693,122 A * 9/1972 Willard ..... 335/174
5,883,557 A * 3/1999 Pawlak et al. ..... 335/179
6,218,921 B1 * 4/2001 Eberts et al. ..... 335/176
6,794,968 B1 * 9/2004 Arnholt ..... 335/179

* cited by examiner

*Primary Examiner*—Ramon M. Barrera

(57) ABSTRACT

An electromagnetic breaker includes a housing (10) having two conductors (30, 31), and a slidable conductor (40) slidably disposed in the housing (10) and movable to engage with the conductors (30, 31) and to electrically couple the conductors (30, 31) together. An electromagnetic device (2) may selectively force the slidable conductor (40) toward and away from the conductors (30, 31). The slidable conductor (40) includes a magnetic member (44), the electromagnetic device (2) includes a core for acting with the magnetic member (44). A spring device (14) may bias the conductors (30, 31) toward the slidable conductor (40). Another spring device (47) may bias the slidable conductor (40) away from the conductors (30, 31).

6 Claims, 4 Drawing Sheets

ELECTROMAGNETIC BREAKER

FIELD OF THE INVENTION

The utility model relates to an electromagnetic breaker for protecting electric facilities from being damaged when electric power supplied to the electric facilities is terminated suddenly.

BACKGROUND OF THE INVENTION

Various kinds of typical breakers have been developed and provided for switching off the electric facilities, and for protecting and preventing the electric facilities from being damaged when the electric power is stop supplying to the electric facilities suddenly, or when the electric power is unstable or is not good enough to energize the electric facilities.

However, when the electric power is supplied to the electric facilities again, the breaker may not be restored back to the original position or to the original working status, and should be switched or operated by the users back to the original position or to the original working status.

In addition, the typical breakers normally include a mechanical structure having a number of parts and elements coupled together, such that the typical breakers may include a large volume that is adverse for both storing and transportation purposes, and such that the manufacturing costs and procedures are complicated.

SUMMARY OF THE INVENTION

It is accordingly an object of the utility model to provide an electromagnetic breaker for maintaining the termination situation to the electric power and when the electric power is supplied to the electric facilities again after the sudden termination of the electric power to the electric facilities.

In accordance with the utility model there is provided an electromagnetic breaker comprising a housing having a first and a second conductors, a third conductor is slidably disposed in the housing and movable to engage with the first and the second conductors and to electrically couple the first and the second conductors together, and an electromagnetic device to selectively force the third conductor toward and away from the first and the second conductors.

The third conductor includes a magnetic member, the electromagnetic device includes a core for acting with the magnetic member. A spring device may bias the first and the second conductors toward the third conductor. A control device may control the electromagnetic device. A processor device may further be provided for controlling the electromagnetic device via the control device. A spring device may further be provided for biasing the third conductor away from the first and the second conductors.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
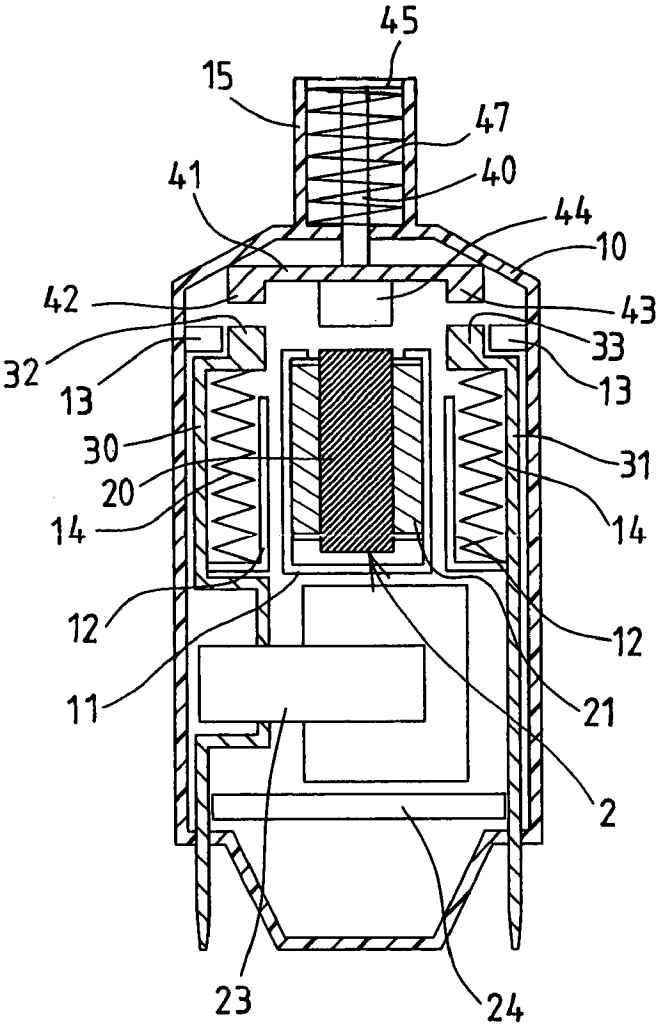
FIG. 1 is a cross sectional view of an electromagnetic breaker.
Figure 4:
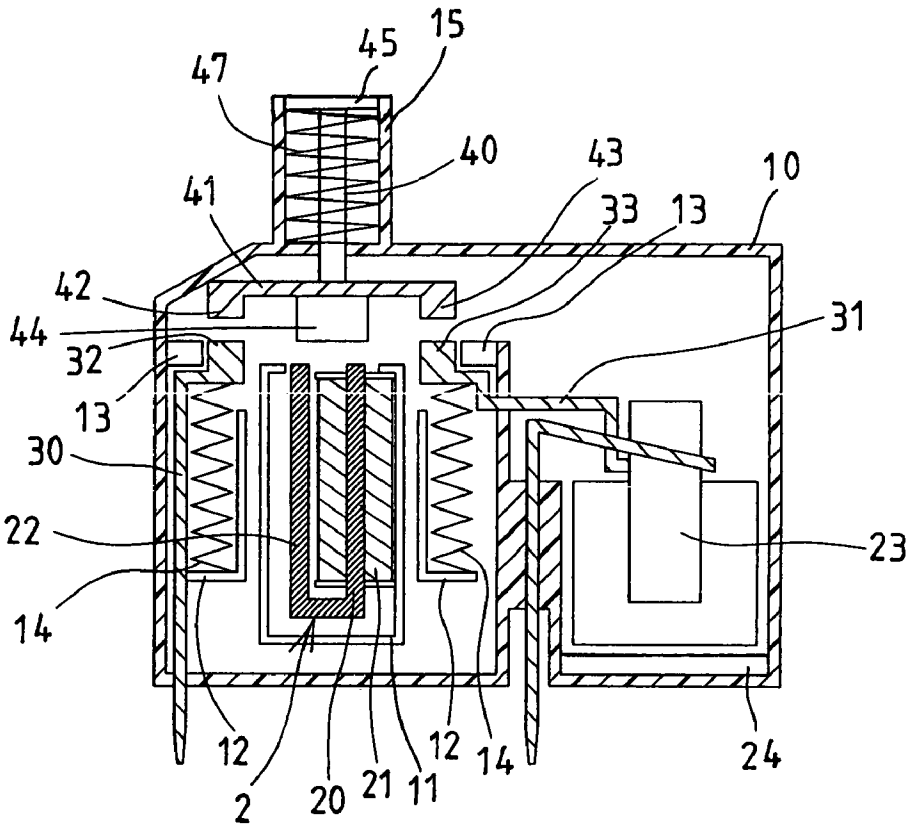
FIGS. 4, 5, 6 are cross sectional views similar to FIGS. 1–3, illustrating the other arrangement of the electromagnetic breaker.

Referring to FIG. 1, an electromagnetic breaker comprises a housing 10 including a casing 11 formed or provided in the housing 10, to receive an electromagnetic device 2 which includes a core 20 and a coil 21 engaged around the core 20.

The electromagnetic device 2 may include a control device 23 disposed in the housing 10, and a processor device 24 for controlling the operation of the core 20 and the coil 21 of the electromagnetic device 2 via the control device 23.

Figure 2:
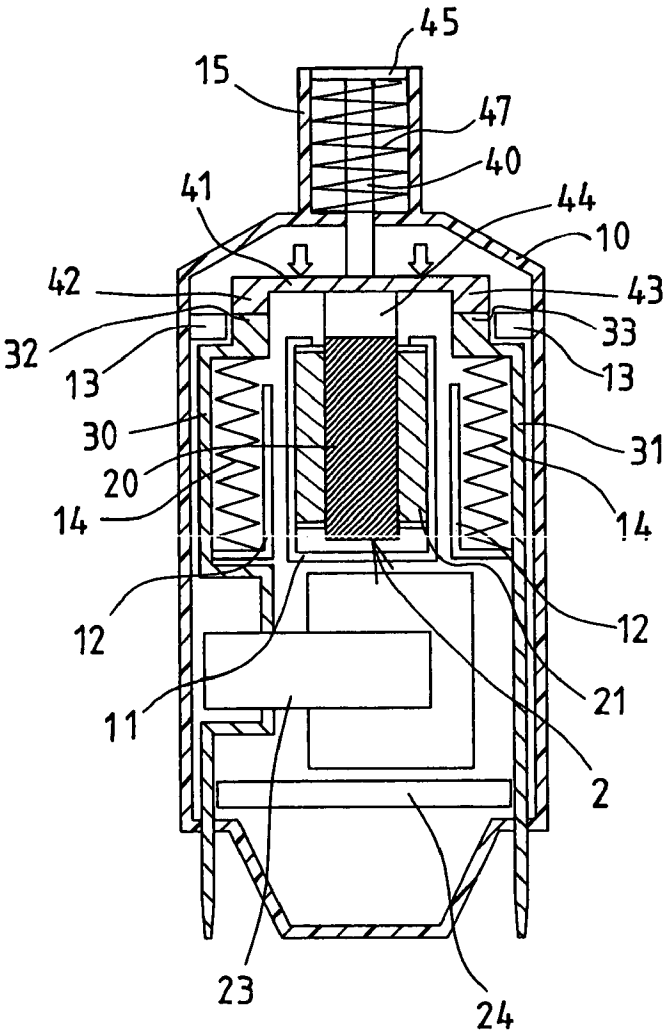
FIGS. 2, 3 are cross sectional views similar to FIG. 1, illustrating the operation of the electromagnetic breaker.
Figure 3:
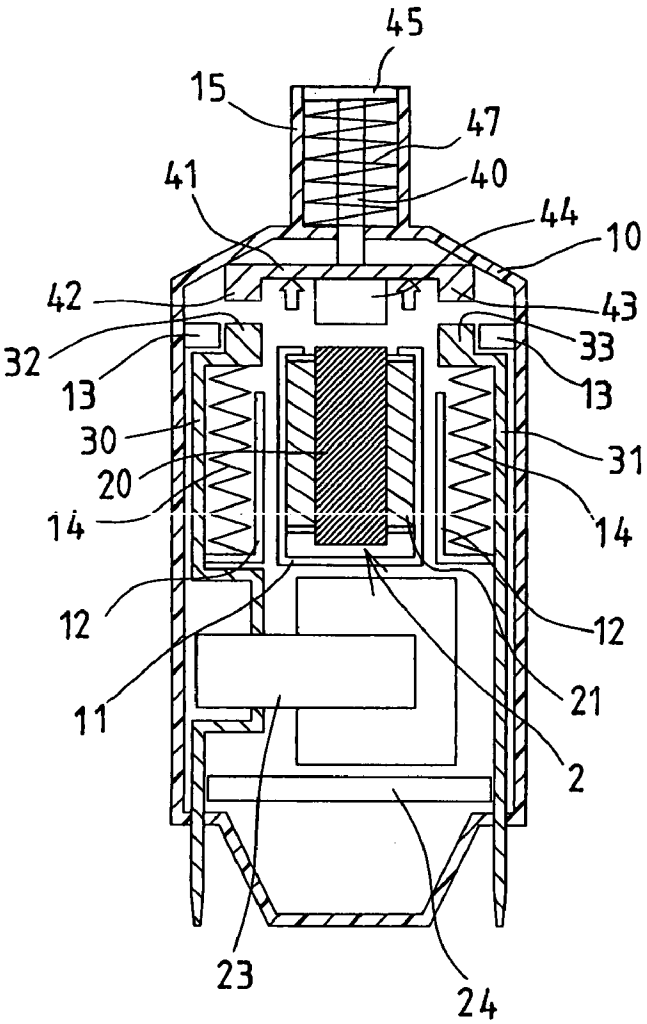

Alternatively, as shown in FIGS. 4–7, the core 20 of the electromagnetic device 2 may include a U-shape having an extension 22 extended out of the coil 21. Further alternatively, the control device 23 and the processor device 24 may be disposed beside the electromagnetic device 2 (FIGS. 4–7) instead of being disposed below the electromagnetic device 2 (FIGS. 1–3).

Figure 7:
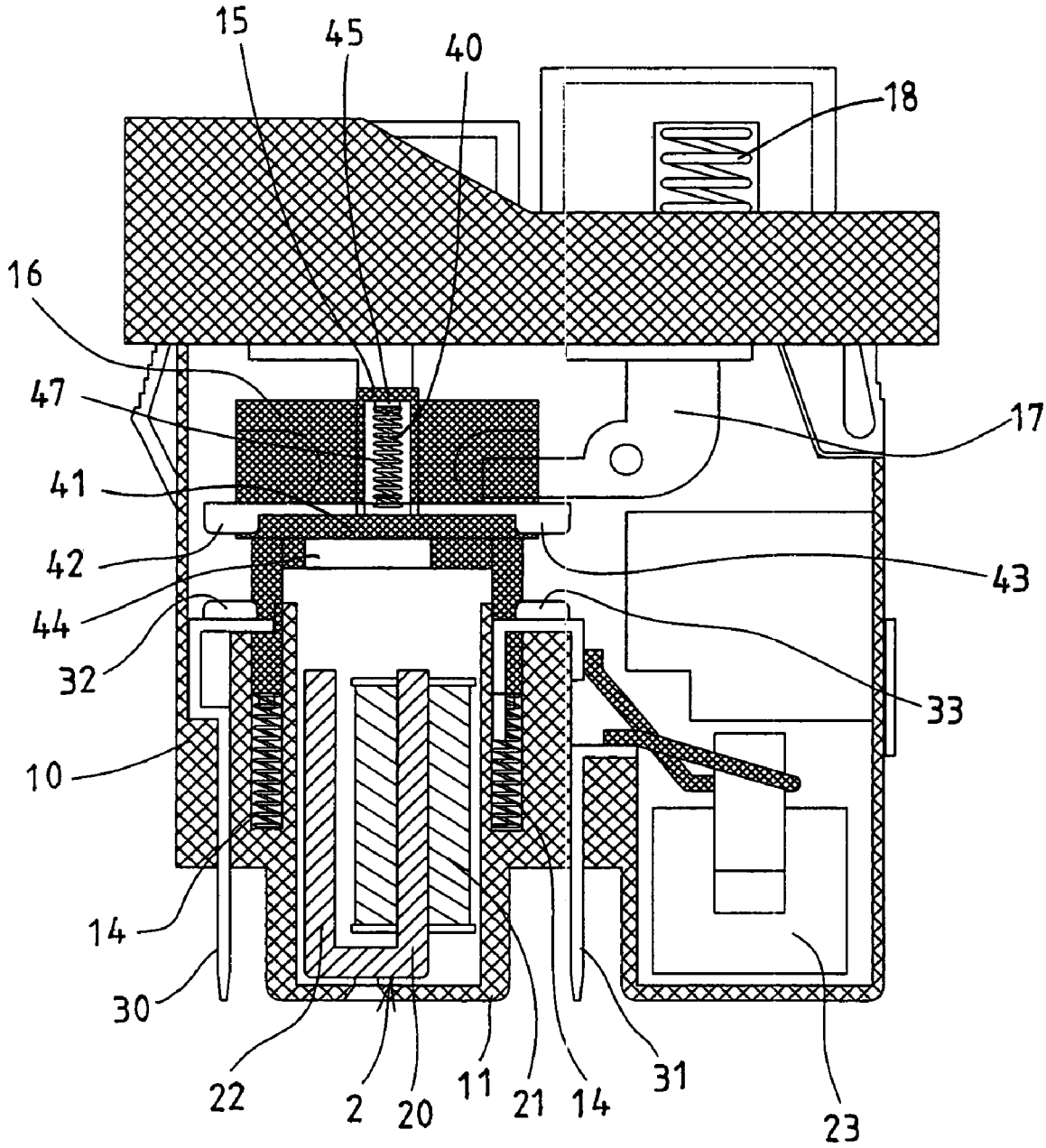
FIG. 7 is a partial cross sectional view, illustrating a further embodiment of the electromagnetic breaker.

The housing 10 includes one or more partitions 12 formed or provided in the housing 10, and one or more springs 14 are received in the partitions 12 of the housing 10. The housing 10 includes one or more stops 13 extended into the housing 10 and includes a compartment 15 formed or provided therein. As shown in FIG. 7, the compartment 15 may be received in a block 16 which may be pivotally and/or resiliently coupled to the housing 10 with an arm 17 and/or a spring 18.

Two conductors 30, 31 are slidably received in the housing 10 and each includes a terminal 32, 33 provided on top and located close to the stops 13 of the housing 10 respectively. The springs 14 are engaged with the conductors 30, 31 to bias the terminals 32, 33 upwardly relative to the housing 10.

A rod 40 is slidably received in the compartment 15 of the housing 10, and includes a conductor 41 attached to the bottom and having two terminals 42, 43 for being moved to selectively engage or contact with the terminals 32, 33 of conductors 30, 31 (FIGS. 2, 5), and thus to electrically couple the terminals 32, 33 of conductors 30, 31 together.

Figure 6:
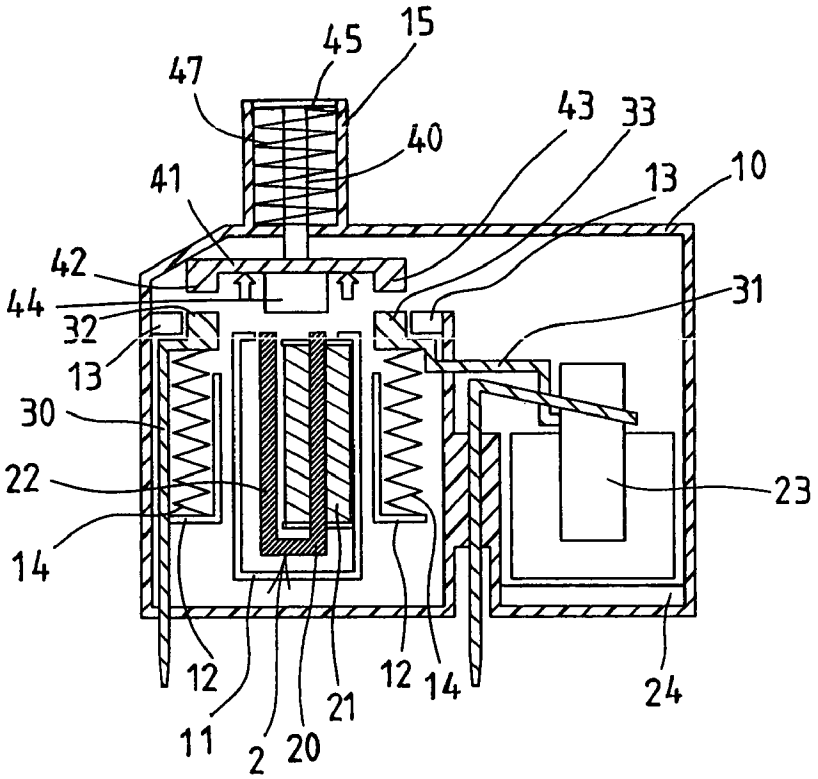

The rod 40 may further include a magnetic member 44 attached to the bottom, or attached to the conductor 41, for being acted with the core 20 of the electromagnetic device 2 (FIGS. 2, 5), and includes a head 45 provided on top for engaging with a spring 47 which may bias the terminals 42, 43 of the conductor 41 away from the terminals 32, 33 of conductors 30, 31 (FIGS. 3, 6).

Figure 5:
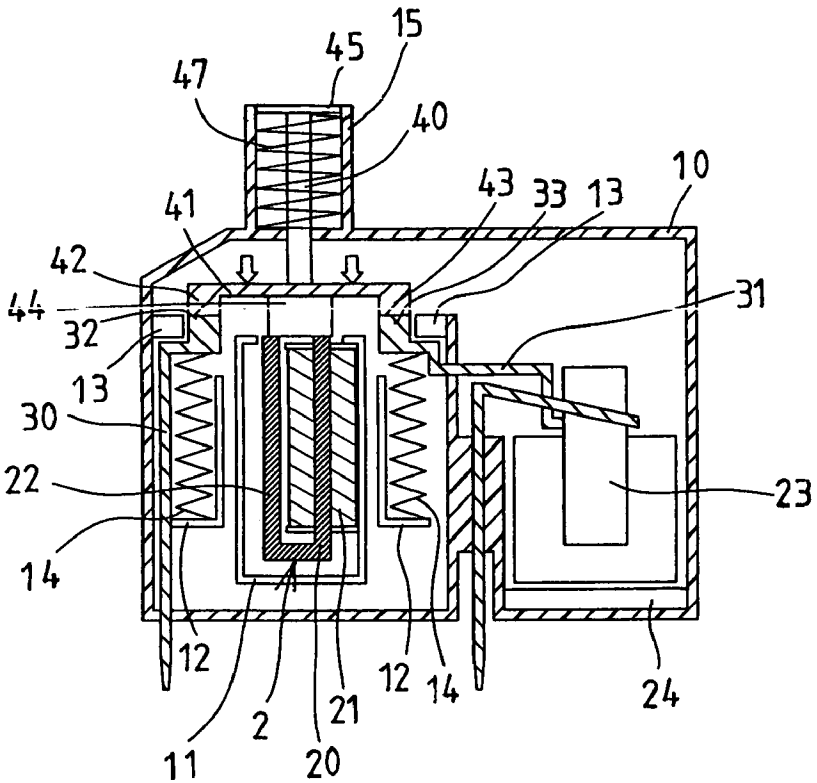

In operation, as shown in FIGS. 2 and 5, when the coil 21 is energized to force the core 20 to attract the magnetic member 44, the terminals 42, 43 of the conductor 41 may be forced and moved to engage or contact with the terminals 32, 33 of conductors 30, 31, in order to electrically couple the terminals 32, 33 of conductors 30, 31 together.

After the magnetic member 44 is attracted to engage with the core 20, the coil 21 may be switched off by such as the processor device 24 via the control device 23. The terminals 42, 43 of the conductor 41 may be maintained in engagement with the terminals 32, 33 of conductors 30, 31 by the magnetic attracting between the magnetic member 44 and the core 20.

When it is required to switch off or disconnect the conductors 30, 31, the users may energize the coil 21 by the processor device 24 and/or the control device 23, to change the electrodes of the core 20, and to repel the magnetic member 44 away from the core 20, and thus to disengage the conductor 40 away from the conductors 30, 31, such that the conductor 40 may be caused to engage with or to be disengaged from the conductors 30, 31 by the processor device 24 and/or the control device 23, and/or via remote control processes.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An electromagnetic breaker comprising a housing (10) including a casing (11) formed in the housing (10) which receives an electromagnetic device (2) which includes a core (20) and a coil (21) engaged around the core (20);

the electromagnetic device (2) including a control device (23) disposed in the housing (10), and a processor device (24) for controlling the operation of the core (20) and the coil (21) of the electromagnetic device (2) via the control device (23);

the housing (10) including at least one partition (12) formed in the housing (10), and at least one first springs (14) being received in the partitions (12) of the housing (10); the housing (10) including at least one stop (13) extended into the housing (10) and including a compartment (15) formed therein;

two first conductors (30, 31) are slidably received in the housing (10) and each including a first terminal (32, 33), respectively provided on top and located close to the stops (13) of the housing 10 respectively; the first spring (14) being engaged with the first conductors (30, 31) to bias the first terminals (32, 33) upwardly relative to the housing 10;

a rod (40) slidably received in the compartment (15) of the housing (10), and includes a second conductor (41) attached to the bottom and having two second terminals (42, 43) for being moved to selectively engage or contact with the first terminals (32, 33) of first conductors (30, 31), and thus to electrically couple the first terminals (32, 33) of first conductors (30, 31) together;

the rod (40) further including a magnetic member (44) attached to the second conductor (41), for being acted with the core (20) of the electromagnetic device (2), and including a head (45) provided on top for engaging with a spring (47) which may bias the terminals (42, 43) of the conductor (41) away from the terminals (32, 33) of conductors (30, 31).

2. The electromagnetic breaker as claimed in claim 1, wherein the core (20) of the electromagnetic device (2) has a U-shape and has an extension (22) extended out of the coil (21).

3. The electromagnetic breaker as claimed in claim 1, wherein the control device (23) and the processor device (24) are disposed beside the electromagnetic device (2) and within the housing (10).

4. The electromagnetic breaker as claimed in claim 1, wherein the control device (23) and the processor device (24) are disposed below the electromagnetic device (2) and within the housing (10).

5. The electromagnetic breaker as claimed in claim 3, wherein the compartment (15) is received in a block which is pivotally and/or resiliently coupled to the housing (10) with an arm (17) and/or a spring (18).

6. The electromagnetic breaker as claimed in claim 4, wherein the compartment (15) is received in a block which is pivotally and/or resiliently coupled to the housing (10) with an arm (17) and/or a spring (18).

* * * * *